US007154429B1

(12) United States Patent
Roberts, Jr.

(10) Patent No.: US 7,154,429 B1
(45) Date of Patent: Dec. 26, 2006

(54) DEVICE FOR PROTECTING MILITARY VEHICLES FROM INFRARED GUIDED MUNITIONS

(76) Inventor: Charles C. Roberts, Jr., 46W192 Granart Rd., Big Rock, IL (US) 60511

( * ) Notice: Subject to any disclaimer, the term of this patent is extended or adjusted under 35 U.S.C. 154(b) by 0 days.

(21) Appl. No.: 11/005,376

(22) Filed: Dec. 6, 2004

(51) Int. Cl.
*G01S 7/495* (2006.01)
*F42B 4/00* (2006.01)
*G01S 13/00* (2006.01)
*G01S 17/00* (2006.01)

(52) U.S. Cl. ..... 342/9; 342/5; 342/7; 89/1.11; 244/1 TD; 244/3.1; 102/335; 102/336

(58) Field of Classification Search ..... 89/1.11; 102/335, 336; 342/5–9, 13; 434/11; 244/1 TD, 244/3.1–3.3
See application file for complete search history.

(56) References Cited

U.S. PATENT DOCUMENTS 4,624,186 A * 11/1986 Widera et al. ..... 102/336
H679 H * 9/1989 Czajkowski, Jr. ..... 342/13
4,970,516 A * 11/1990 Nicolson ..... 342/13
5,249,527 A * 10/1993 Schwind ..... 89/1.11
5,397,236 A * 3/1995 Fegg et al. ..... 434/11
5,497,156 A * 3/1996 Bushman ..... 342/9
6,055,909 A * 5/2000 Sweeny ..... 102/336
6,230,629 B1 * 5/2001 Doctor et al. ..... 89/1.11
2002/0149510 A1 * 10/2002 Salzeder ..... 342/13

FOREIGN PATENT DOCUMENTS

GB 2387430 A * 10/2003
WO WO 9604520 A1 * 2/1996

* cited by examiner

*Primary Examiner*—Bernarr E. Gregory

(57) ABSTRACT

A heat seeking missile decoy device mounted on a military vehicle to change the infrared signature of the military vehicle. The device is at ambient temperature when stored on the military vehicle. When a heat seeking missile is fired at the military vehicle, the decoy device deploys and increases in temperature, changing the infrared signature of the vehicle and causing a hot spot away from vulnerable components of the vehicle. The hot spot radiates in the infrared in an area that is away from vulnerable parts of a military vehicle, drawing the heat seeking missile toward it. The termination trajectory of the heat seeking missile is at the end of the decoy device and not the vulnerable parts of the military vehicle. The energy required to heat the device is passive waste energy from the vehicle engine exhaust.

3 Claims, 3 Drawing Sheets

DEVICE FOR PROTECTING MILITARY VEHICLES FROM INFRARED GUIDED MUNITIONS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of machines and more specifically to a device for countering heat seeking missiles aimed at military vehicles. Military vehicles are vulnerable to heat seeking missiles that utilize infrared radiation from the targeted vehicle as a means of guidance. The infrared (IR) characteristic or signature of a military vehicle is recognized by the infrared detection apparatus on a heat seeking missile and is transmitted to the aerodynamic surfaces that adjust trajectory on the way to the target. The device for protecting military vehicles from heat seeking missiles utilizes a decoy strategy by illuminating a less vulnerable part of the military vehicle in the infrared spectrum. The infrared decoy device is an apparatus that changes the infrared signature of the military vehicle once a heat seeking missile has been fired. It changes the temperature distribution on the military vehicle in a manner that lures the heat seeking missile away from vulnerable parts of the vehicle such that the heat seeking missile terminates harmlessly at the end of the decoy device. The infrared decoy device is at an ambient temperature prior to deployment. When deployed, the infrared decoy device rapidly increases in temperature and moves to a location away from the targeted military vehicle. The increase in temperature changes the thermal signature of the targeted military vehicle, luring the heat seeking missile away from vulnerable components.

BRIEF SUMMARY OF THE INVENTION

The primary object of the invention is a reflux heat pipe that alters the infrared signature of a military vehicle in order to lure an infrared heat seeking missile away from vulnerable parts of the military vehicle.

Another object of the invention is a movable heat pipe that utilizes rejected heat from the vehicle to increase in temperature.

Another object of the invention is a heat pipe with low heat capacity for a nearly instantaneous change in temperature, once vehicle exhaust gases impinge on the heat input section.

Yet another object of the invention is movable structure with a high temperature portion that can be configured to a variety of shapes to alter the vehicle infrared signature of a military vehicle.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a movable, high rate of heat transfer, low heat capacity device that alters the thermal signature of a military vehicle to decoy a thermally guided munition away from a military vehicle comprising: A high rate of heat transfer device such as a heat pipe with an insulated adiabatic section and an end part or condensing area with relatively high temperature compared to the skin of the military vehicle. The device has a means of folding when not in use and deploying quickly when a munition is detected. The structure is shaped and insulated such that the highest temperature is at the end of the device which, when deployed, is relatively far from vulnerable parts of the military vehicle.

BRIEF DESCRIPTION OF THE DRAWINGS

The drawings constitute a part of this specification and include exemplary embodiments to the invention, which may be embodied in various forms. It is to be understood that in some instances, various aspects of the invention may be shown exaggerated or enlarged to facilitate an understanding of the invention.

DETAILED DESCRIPTION OF THE PREFERRED EMBODIMENT

Detailed descriptions of the preferred embodiment are provided herein. It is to be understood, however, that the present invention may be embodied in various forms.

Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
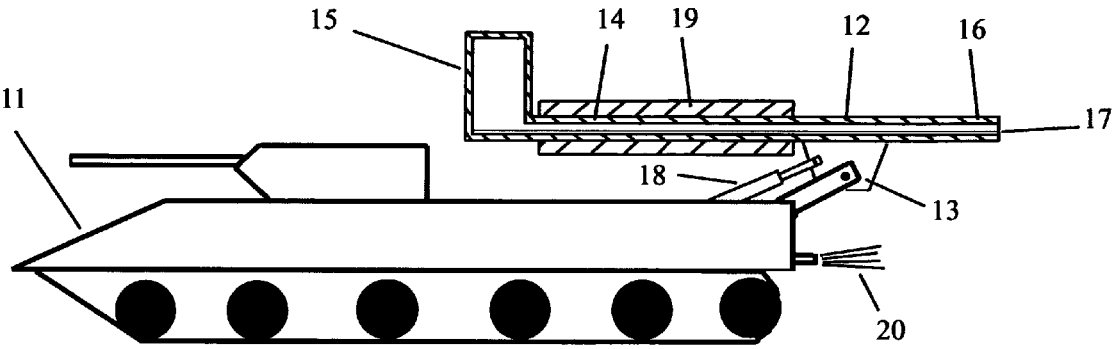
FIG. 1 is a perspective view of the invention showing a military vehicle with the infrared signature altering device in the folded position.

Referring now to the drawing, there is depicted in FIG. 1 a perspective view of a military vehicle 11 equipped with the heat seeking missile decoy device 12. The decoy device 12 is in the folded condition and at ambient temperature. The device 12 is attached to the military vehicle by a pivot assembly 13 which allows the device to deploy when required. An hydraulic actuator 18 deploys the decoy device when needed. The device has a heat input section 16, an adiabatic section 14 and a heat rejection section 15. The adiabatic section 14 is covered with insulation to mask the temperature of the device from being detected by heat seeking missiles. The heat rejection section 15 of the device is not insulated and radiates infrared radiation to the ambient environment. The heat rejection section is at ambient temperature when the device is folded and does not alter the infrared signature of the vehicle.

Figure 2A:
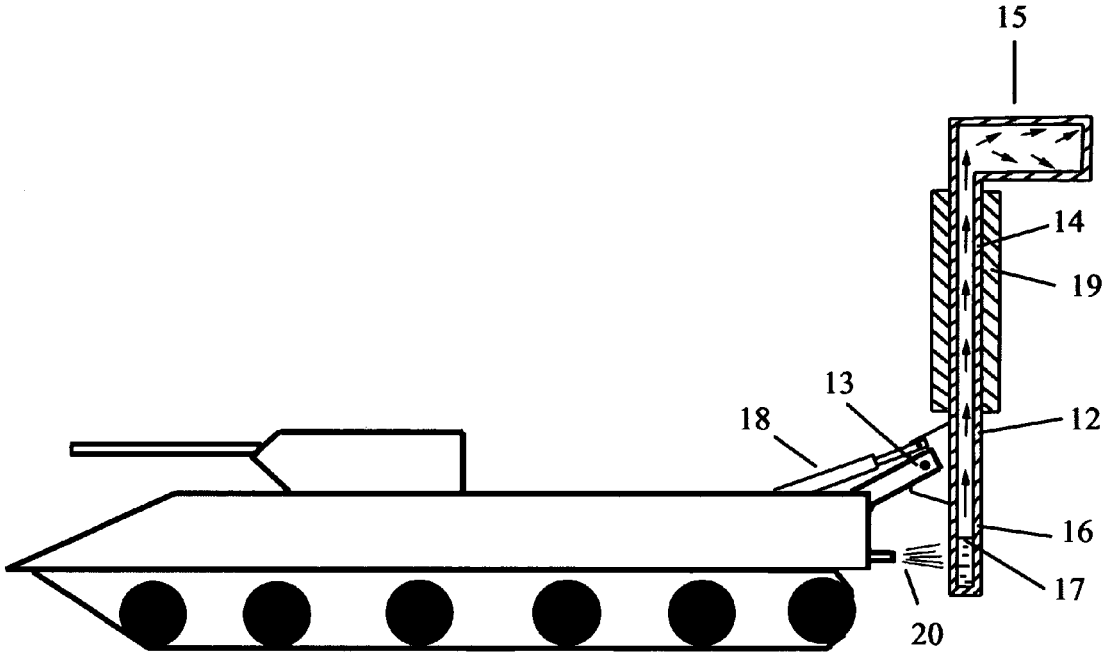
FIG. 2A is a perspective view of the invention showing a military vehicle with the infrared signature altering device in the deployed position.

FIG. 2A for purpose of illustrative disclosure, is a preferred embodiment of the heat seeking missile decoy device in the deployed position, comprising a long, slender heat pipe 12, a pivoting device 13, a heat input section 16, an insulated adiabatic section 14 where no heat transfer to the environment occurs, and a heat rejection section 15 that is uninsulated and radiates infrared radiation. A heat source such as the waste heat from the vehicle internal combustion engine exhaust 20 provides heat to the device. Heat is transferred from the heat input section 16, through the adiabatic section 14 and is transferred to the environment at the uninsulated heat rejection section 15. The hot heat rejection section 15 is a dominant hot spot which is illuminated in the infrared and draws the heat seeking missile toward it. The missile will then strike the heat rejection section 15 thereby missing the vulnerable components of the military vehicle. The internal configuration of the device is that of a reflux heat pipe. A vaporizing liquid absorbs heat and generates vapor at the liquid vapor interface 17. Vapor then travels through the adiabatic section 14 and condenses in the heat rejection section 15. Liquid condensate drains back by gravity.

Figure 2B:
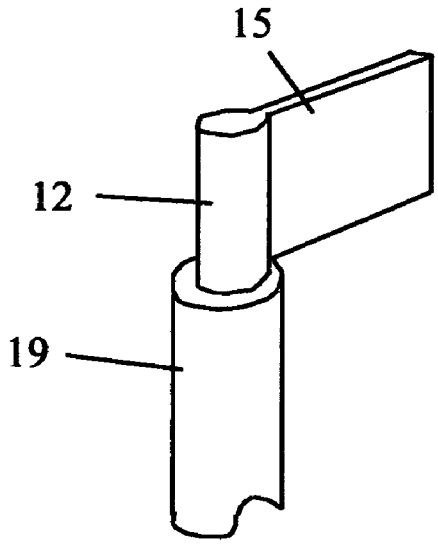
FIG. 2B is a perspective view of the heat rejection section of the heat pipe which emits infrared radiation and lures the attacking heat seeking missile toward it.

FIG. 2B shows the heat rejection section in more detail. The heat pipe condensing area 15 is exposed to radiate in the infrared in order to attract heat seeking missiles. The insulation 19 around the heat pipe body 12 blocks infrared radiation so as to isolate the infrared hot spot from the targeted military vehicle.

What is claimed is:

1. A device for defeating infrared (IR) guided missile attacks on a military vehicle with an exhaust pipe that expels high temperature engine exhaust gases comprising:

a decoy having a long slender reflux heat pipe of arbitrary dimensional thickness, a heat input section which absorbs heat from hot gases expelled from the military vehicle engine exhaust, containing a liquid that vaporizes, an adiabatic section with thermal insulation to prevent emission of infrared radiation and act as a conduit for liquid and vapor, a heat rejection section which emits infrared radiation so as to attract heat seeking missiles fired at the military vehicle a deploying means which moves the device from a standby mode, where no heat is being transferred through the device, to an active mode where the military vehicle exhaust gases impinge on the heat input section, causing infrared heat rejection at the upper end of the device.

2. The apparatus set forth in claim 1 wherein said infrared decoy device moves from a stored position to a deployed position utilizing waste heat from the military vehicle internal combustion engine exhaust, causing heat to transfer to a heat input section, through an adiabatic section and to said heat rejection section, attracting the heat seeking missile to said heat rejection section and away from the military vehicle.

3. The apparatus set forth in claim 1 wherein said heat seeking missile decoy device is a heat pipe with a large heat rejection section mounted on a pivot with the heat input section receiving rejected heat from the military vehicle.

* * * * *